US008581569B2

(12) United States Patent
Fonderie

(10) Patent No.: US 8,581,569 B2
(45) Date of Patent: Nov. 12, 2013

(54) SUPPLY INDEPENDENT CURRENT REFERENCE GENERATOR IN CMOS TECHNOLOGY

(75) Inventor: M. Jeroen Fonderie, Milpitas, CA (US)

(73) Assignee: Touchstone Semiconductor, Inc., Milpitas, CA (US)

( * ) Notice: Subject to any disclaimer, the term of this patent is extended or adjusted under 35 U.S.C. 154(b) by 442 days.

(21) Appl. No.: 13/034,148

(22) Filed: Feb. 24, 2011

(65) Prior Publication Data

US 2012/0217951 A1 Aug. 30, 2012

(51) Int. Cl.
*G05F 3/16* (2006.01)

(52) U.S. Cl.
USPC ..... 323/316

(58) Field of Classification Search
USPC ..... 323/313, 314, 315, 316
See application file for complete search history.

(56) References Cited

U.S. PATENT DOCUMENTS 5,949,278 A 9/1999 Oguey
7,046,077 B2 * 5/2006 Ozasa et al. ..... 327/541
7,053,695 B2 * 5/2006 Ozasa et al. ..... 327/541
7,990,207 B2 * 8/2011 Nishimori ..... 327/543
2012/0217951 A1 * 8/2012 Fonderie ..... 323/316

OTHER PUBLICATIONS

Nauta, H.C. et al. "New Class of High-Performance PTAT Current Sources." Electronics Letters, pp. 384-386, Issue Date: Apr. 25, 1985.
Oguey, Henri J. et al. "CMOS Current Reference Without Resistance." IEEE Journal of Solid-State Circuits, vol. 32, No. 7, Jul. 1997. pp. 1132-1135.

* cited by examiner

*Primary Examiner* — Jeffrey Sterrett
(74) *Attorney, Agent, or Firm* — Gary Stanford

(57) ABSTRACT

A current reference generator including a current network, a bias network, and a loop amplifier. The current network includes first and second transistors of a first conductivity type and third, fourth and fifth transistors of a second conductivity type. The first, third and fifth transistors are series-coupled between voltage supply lines forming a first current path, and the second and fourth transistors are series-coupled between the supply lines forming a second current path. The control terminals of the first and second transistors are coupled together and the control terminals of the third and fourth transistors are coupled together. The bias network biases the fifth transistor. The loop amplifier is coupled to the current network and is operative to maintain constant current level through the first and second current paths independent of voltage variations of the supply lines and at very low supply voltage.

22 Claims, 3 Drawing Sheets

SUPPLY INDEPENDENT CURRENT REFERENCE GENERATOR IN CMOS TECHNOLOGY

FIELD OF THE INVENTION

The present invention relates in general to current reference generators in CMOS technology, and particularly to CMOS current reference generators that are capable of operating with very low supply voltage.

BACKGROUND OF THE INVENTION

A current reference generator is a useful component for providing a known current level within an electronic circuit. Classic current reference generators were typically implemented using bipolar transistors and resistors and the like. Many modern electronic devices, however, are implemented using complementary metal-oxide semiconductor (CMOS) technology for reduced size and power consumption. CMOS technology, for example, is particularly advantageous for smaller and/or lower power electronic devices including those which are powered by a battery. Although bipolar devices may be integrated along with CMOS devices on a common chip (e.g., BiCMOS or BiMOS), it is preferred to implement as many devices components as possible using the same process because it is generally easier, less expensive, and more efficient. Resistors can also be problematic since they generally consume a significant amount of space, and precision resistors are relatively difficult to fabricate.

U.S. Pat. No. 5,949,278, entitled "Reference Current Generator In CMOS Technology," invented by Henri Oguey taught an implementation of a CMOS current reference generator without the use of bipolar devices or resistors. The CMOS current reference generator described in this patent exhibited insensitivity to temperature and process variations. The primary configuration described therein, however, also exhibited an undesirable degree of dependence upon the supply voltage. An additional configuration was described which added a cascode stage to reduce the dependence upon supply voltage variations. The added series-coupled cascode stage, however, increased the minimum supply voltage level sufficient to properly operate the current generator. In particular, the added cascode stage raised the minimum supply voltage to about twice the threshold voltage ($V_T$) of the individual MOS transistors, or to about $2V_T$. Although MOS devices do not completely shut down when their gate-to-source voltage ($V_{GS}$) is below $V_T$ for sub-threshold operation, the current becomes very low during sub-threshold operation so that $V_T$ is a practical limitation for reliable operation. The $V_T$ of most readily available technologies is above 0.7 Volts (V), so that the current generator described by the Oguey patent implemented using these technologies required a supply voltage of well over 1V (e.g., 1.4-1.8V). Certain newer technologies have reduced $V_T$ of the devices to about 0.4V. Nonetheless, the requirement that the current generator operate with a supply voltage of about $2V_T$ prevents the full benefits of the lower voltage technologies.

The higher voltage level is not advantageous for certain applications, such as battery-operated devices with limited supply voltage range. It is desired to provide a current reference generator that is independent of supply voltage and which successfully operates using a supply voltage of at the threshold voltage $V_T$ of the applicable technology.

BRIEF SUMMARY OF INVENTION

A current reference generator including a current network, a bias network, and a loop amplifier. The current network includes first second and transistors of a first conductivity type and third, fourth and fifth transistors of a second conductivity type. The first and second transistors each have a first current terminal coupled to a first supply line and a control terminal coupled to a first node. The first transistor has a second current terminal coupled to a second node and the second transistor has a second current terminal coupled to a third node. The third transistor has a first current terminal coupled to the second node, a control terminal coupled to a fourth node, and a second current terminal coupled to a fifth node. The fourth transistor has a first current terminal coupled to the third node, a control terminal coupled to the fourth node, and a second current terminal coupled to a second supply line. The fifth transistor has a first current terminal coupled to the fifth node, a second current terminal coupled to the second supply line, and has a control terminal. The bias network is coupled to at least one of the supply lines and has a control output coupled to the control terminal of the fifth transistor. The loop amplifier is coupled to the current network and is operative to maintain relatively constant current level through the current terminals of the fifth transistor.

In a first configuration, the third transistor is diode-coupled in which the second and fourth nodes are coupled together, and the loop amplifier has an input coupled to the third node and an output driving the first node. In a more specific first configuration, the loop amplifier is implemented using a sixth transistor of the first conductivity type and a seventh transistor of the second conductivity type. The sixth transistor has a first current terminal coupled to the first supply line and is diode-coupled having a second current terminal and a control terminal coupled together at the first node. The seventh transistor in this configuration has a first current terminal coupled to the first node, a second current terminal coupled to the second supply line, and a control terminal coupled to the third node. A capacitor may be provided and coupled between the control terminal of the seventh transistor and the second supply line.

In a second configuration, the second transistor is diode-coupled in which the first and third nodes are coupled together, and the loop amplifier has an input coupled to the second node and an output driving the fourth node. In a more specific second configuration, the loop amplifier is implemented using a sixth transistor of the first conductivity type and a seventh transistor of the second conductivity type. The sixth transistor has a first current terminal coupled to the first supply line, a control terminal coupled to the second node, and a second current terminal coupled to the fourth node. The seventh transistor in this configuration is diode-coupled having a first current terminal and a control terminal coupled together at the fourth node, and has a second current terminal coupled to the second supply line. A capacitor may be provided and coupled between the control terminal of the sixth transistor and the second supply line.

In any of these configurations, a startup network may be provided to initiate desired current flow through the current branches of the current network. Also, one or more reference or output devices may be provided to tap a reference current for use. Dual configurations are also contemplated by swapping polarities of the supply lines and the transistor types.

BRIEF DESCRIPTION OF THE DRAWINGS

The benefits, features, and advantages of the present invention will become better understood with regard to the following description, and accompanying drawings where.

DETAILED DESCRIPTION OF THE INVENTION

The following description is presented to enable one of ordinary skill in the art to make and use the present invention as provided within the context of a particular application and its requirements. Various modifications to the preferred embodiment will, however, be apparent to one skilled in the art, and the general principles defined herein may be applied to other embodiments. Therefore, the present invention is not intended to be limited to the particular embodiments shown and described herein, but is to be accorded the widest scope consistent with the principles and novel features herein disclosed.

Figure 1:
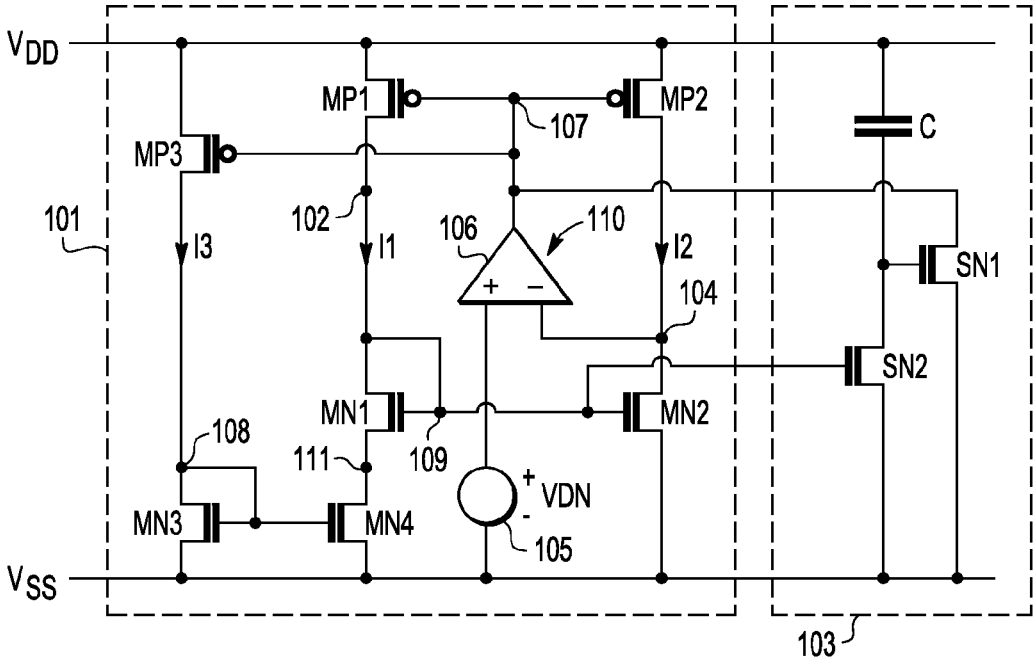
FIG. 1 is a schematic diagram of a current reference generator implemented according to one embodiment coupled to a startup network.

FIG. 1 is a schematic diagram of a current reference generator 101 implemented according to one embodiment coupled to a startup network 103. The current reference generators described herein are implemented using transistors of complementary conductivity types, such as P-type or P-channel metal-oxide semiconductor (MOS) transistors (or PMOS transistors) and N-type or N-channel MOS transistors (or NMOS transistors). The current reference generators described herein may be implemented using CMOS technology in which the transistors are coupled to supply voltage lines shown as VDD and VSS, in which VSS provides a reference voltage level (e.g., ground) and VDD develops a difference voltage level relative to VSS to establish proper circuit operation. Although VDD and VSS are usually configured to provide a relatively stable voltage difference, variations may occur. The current reference generators described herein establish at least one reference current that remains relatively constant in spite of variations of VDD and/or VSS (or, generally, variations of the voltage difference between VDD and VSS). Also, the current reference generators described herein maintain a valid reference current for a very low voltage difference between VDD and VSS, such as a supply voltage at about the threshold voltage ($V_T$) of the MOS transistors of the applicable MOS technology.

The current reference generator 101 includes PMOS transistors MP1, MP2 and MP3, NMOS transistors MN1, MN2, MN3 and MN4, an operational amplifier (op-amp) 106 and a voltage source 105. MP1, MP2 and MP3 each have a source coupled to VDD and a gate coupled to a node 107, which is further coupled to the output of the op-amp 106. Thus, the gates of MP1-MP3 are driven by the output of the op-amp 106 at node 107. MP1 has its drain coupled to the drain of MN1 at a node 102, MP2 has its drain coupled to the drain of MN2 at a node 104, and MP3 has its drain coupled to the drain of MN3 at a node 108. The sources of MN2, MN3 and MN4 are each coupled to VSS. MN4 has its drain coupled to the source of MN1 at a node 111. The gates of MN1 and MN2 are coupled together at a node 109, and MN1 is diode-coupled so that its drain is also coupled to its gate at node 109 (so that nodes 102 and 109 are coupled together). The gates of MN3 and MN4 are coupled together at node 108 and MN3 is diode-coupled having its drain coupled to its gate. The voltage source 105 develops a voltage VDN, and has a negative terminal coupled to VSS and a positive terminal coupled to a non-inverting (+) input of the op-amp 106. The inverting (−) input of op-amp 106 is coupled to the drains of MP2 and MN2.

The op-amp 106 and the voltage source 105 are coupled and configured to operate as a loop amplifier 110 as further described herein. The series-coupled drain-source configuration of the transistors MP1, MN1 and MN4 forms a first current path having a current I1. The series-coupled drain-source configuration of the transistors MP2 and MN2 forms a second current path having a current I2. The series-coupled drain-source configuration of the transistors MP3 and MN3 forms a third current path having a current I3.

The startup network 103 includes NMOS transistors SN1 and SN2 and a capacitor C. SN1 and SN2 have their sources coupled to VSS. The drain of SN2 is coupled to the gate of SN1 and to one end of the capacitor C. The other end of C is coupled to VDD. The drain of SN1 is coupled to node 107. The gate of SN2 is coupled to node 109. Operation of the startup network 103 is further described below.

In operation of the current reference generator 101, the loop amplifier 110 drives the gates of MP1 and MP2 at node 107 forcing their drain currents I1 and I2 to be defined by the ratio of the sizes of MP1 and MP2. In one embodiment, MP1 and MP2 are matched transistors having approximately the same size so that the currents I1 and I2 are approximately the same. Also, MN1 may be sized larger than MN2 so that the gate-to-source voltage $V_{GS}$ of MN2 is larger than the $V_{GS}$ of MN1. The voltage difference between the $V_{GS}$ of MN1 and MN2 develops as the drain-source voltage of MN4, which is the voltage at node 111 relative to VSS. In one embodiment, MP3 is sized about the same as MP1 and MP2 so that the current I3 is effectively a mirror image current of the currents I1 and I2 (e.g., I1=I2=I3). MP3 and the diode-coupled MN3 collectively form a bias network to establish a gate voltage for MN4. MN3 and MN4 are also coupled in a current mirror configuration to equalize I1 and I3. The level of the currents I1 and I2 (and I3) is determined by the size of MN4 and the ratio of sizes of MN1 and MN2.

In one embodiment, the voltage VDN of the voltage source 105 is chosen to be about the same as the voltage of node 109 relative to VSS. Although the non-inverting input of the op-amp 106 may be coupled directly to node 109, an independent voltage source is also contemplated. In one embodiment, a separate transistor configuration (not shown) is coupled to develop the appropriate voltage level. In another embodiment, the expected voltage of 109 is configured or otherwise known and the voltage source 105 independently develops the expected voltage level. The op-amp 106 may be independently configured on the same integrated circuit (IC) chip and configured with suitable parameters and characteristics. Alternatively, the op-amp 106 is implemented using complementary devices as further described below. The virtual ground input of the op-amp 106 drives the drains of MP2 and MN2 to about the same voltage of VDN. The drain-source voltages of the pair of transistors MN1 and MN2 are about the same regardless of variations of VDD and/or VSS, and the drain-source voltages of the pair of transistors MP1 and MP2 are also about the same regardless of variations of VDD and/or VSS. Thus, the currents I1 and I2 are not dependent upon the supply voltage between VDD and VSS. Furthermore, the current reference generator 101 exhibits insensitivity to temperature and process variations.

In summary for the current reference generator 101, the current level of I1-I3 is essentially determined by the relative sizes of MN1, MN2 and MN4 (assuming MP1-MP3 are configured to be approximately the same size). MN3 may be configured to be smaller than up to about the same size as MN4. The loop amplifier 110 operates to drive the gates of MP1-MP3 to equalize the currents I1-I3. Because of the operation of the loop amplifier 110, the current level of each of the currents I1-I3 remains substantially independent of the voltage difference between VDD and VSS down to a very low voltage level, such as about the threshold voltage $V_T$ of the MOS transistors.

At least one significant benefit of the current reference generator 101 is that the currents I1-I3 remain relatively constant and are relatively independent of the supply voltages VDD and VSS. Thus, changes of VDD and/or VSS does not appreciably affect the level of current I1-I3 through the current branches, resulting in a very reliable and stable current reference. In prior art or conventional configurations using current mirrors or the like, the branch currents exhibited dependency on the supply voltage which required relatively stable supply voltages.

Another significant advantage of the current reference generator 101 is that the voltage difference between VDD and VSS may be very low without affecting current reference operation. In prior art or conventional configurations using current mirrors or the like, the dependency upon the supply voltage may be reduced by adding a cascode stage or the like between the transistor pairs MP1/MP2 and MN1/MN2. Although the cascode stage reduced dependence upon supply voltage, it increased the minimum voltage level needed between VDD and VSS to ensure proper operation (e.g., to ensure that the transistors operated in the appropriate operating modes for reference current operation). In typical conventional configurations using the added cascode stage, the minimum voltage difference between VDD and VSS for proper operation was about twice the threshold voltage $V_T$ of the MOS devices. The minimum voltage difference between VDD and VSS for the current reference generator 101 is about $V_T$, or even just below $V_T$ for sub-threshold operation, which is particularly advantageous for battery-operated electronic devices. Further, although the voltage difference between VDD and VSS may be at very low levels, it may also be increased to higher voltage levels without changing the current levels of I1-I3. The maximum voltage difference depends upon the breakdown voltages of the CMOS devices (PMOS and NMOS devices). Also, the current reference generator 101 exhibits insensitivity to temperature and process variations.

The startup network 103 is provided to ensure proper initial startup operation of the current reference generator 101. Upon startup, the capacitor C is initially discharged pulling the gate of SN1 high thus initially turning SN1 on. While turned on, SN1 pulls current through the PMOS transistors MP1-MP3 which causes current flow of I1-I3 through the respective current branches. A corresponding voltage develops on the gate of SN2 at node 109, which turns SN2 on to charge the capacitor C, which eventually charges to a sufficient level to turn off SN1. SN2 does not draw appreciable current so that the current reference generator 101 operates in accordance with normal operation after SN1 is turned off. The specific startup network 103 shown illustrates only one of many different methods to achieve start up operation.

Figure 2:
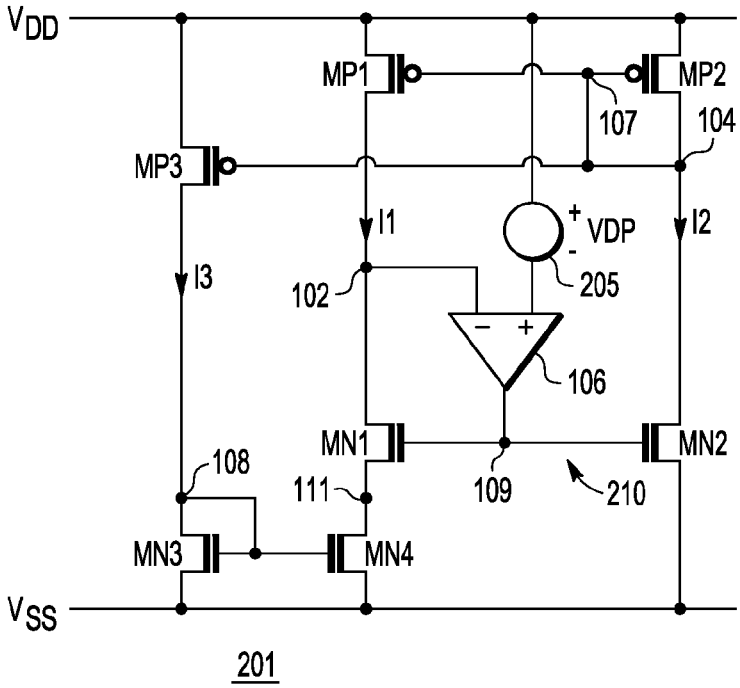
FIG. 2 is a schematic diagram of another current reference generator implemented according to another embodiment similar to the current reference generator of FIG. 1.

FIG. 2 is a schematic diagram of another current reference generator 201 implemented according to another embodiment similar to the current reference generator 201. The startup network 103 is not shown in FIG. 2 but may be included and coupled to the current reference generator 201 in substantially the same manner. The current reference generator 201 is substantially similar to the current reference generator 101 in which similar components and devices assume identical reference numbers. The transistors MP1-MP3 and MN1-MN4 are configured in substantially the same manner and also coupled in substantially the same manner (via nodes 102, 104, 107, 108, 109, 111), except that MN1 is not diode-coupled and MP1 is diode-coupled. Thus, the gate of MN1 is not coupled to its own drain and the gate of MP2 is coupled to its own drain. The gates of MP1 and MP2 are coupled together in similar manner at node 107, which is further coupled to the drain of MP2 at node 104 (so that nodes 104 and 107 are coupled together). Nodes 102 and 109 are not coupled together. The voltage source 105 is replaced by a voltage source 205 developing a voltage VDP. The op-amp 103 is included, except that its inverting (−) input is coupled to the drains of MN1 and MP1, its non-inverting (+) input is coupled to the negative terminal of the voltage source 205, and its output is coupled to node 209. The positive terminal of the voltage source 205 is coupled to VDD. The op-amp 103 and the voltage source 205 are coupled to operate as a loop amplifier 210 in analogous manner as the loop amplifier 110.

In operation of the current reference generator 201, the loop amplifier 210 drives the gates of MN1 and MN2 at node 209 forcing their drain currents I1 and I2 to be approximately equal. In one embodiment, the voltage VDP is chosen to be about the same voltage level as the voltage of node 107 relative to VDD. The voltage source 205 may be implemented in a similar manner as described above for the voltage source 105. The virtual ground input of the op-amp 106 drives the drains of MP1 and MN1 to about the same voltage of VDP. Again, the drain-source voltages of the pair of transistors MN1 and MN2 are about the same regardless of variations of VDD and/or VSS, and the drain-source voltages of the pair of transistors MP1 and MP2 are also about the same regardless of variations of VDD and/or VSS. Thus, the currents I1 and I2 are substantially independent upon the supply voltage between VDD and VSS. Also, the current reference generator 201 exhibits insensitivity to temperature and process variations In summary for the current reference generator 201, the current level of I1-I3 is essentially determined by the relative sizes of MN1, MN2 and MN4 (assuming MP1-MP3 are configured to be approximately the same size). MN3 may be configured to be smaller than up to about the same size as MN4. The loop amplifier 210 operates to drive the gates of MN1 and MN2 to equalize the currents I1-I3. Substantially the same benefits of the current reference generator 101 are achieved by the current reference generator 201. The currents I1-I3 are relatively constant and independent of the supply voltages VDD and VSS, so that changes of VDD and/or VSS does not appreciably affect the level of current through the current branches, resulting in a very reliable and stable current reference. The voltage difference between VDD and VSS may be very low, such as about the threshold voltage $V_T$ as previously described, which again is particularly advantageous for battery-operated electronic devices. Also, the voltage difference between VDD and VSS may be significantly higher without changing the current levels of I1-I3.

Figure 3:
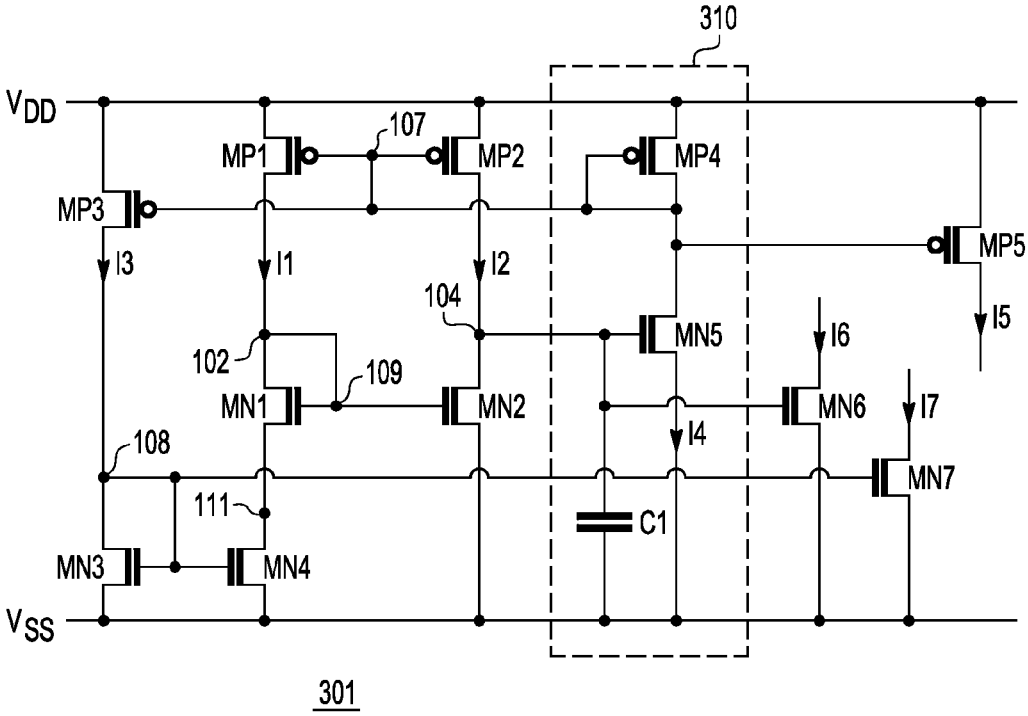
FIG. 3 is a schematic diagram of another current reference generator implemented according to another embodiment which is similar to the current reference generator of FIG. 1 including complementary devices implementing the loop amplifier.

FIG. 3 is a schematic diagram of another current reference generator 301 implemented according to another embodiment. The startup network 103 is not shown but may be included and coupled to the current reference generator 301 in substantially the same manner as previously described. The current reference generator 301 is substantially similar to the current reference generator 101 in which similar components and devices assume identical reference numbers. The transistors MP1-MP3 and MN1-MN4 are configured in substantially the same manner and also coupled in substantially the same manner in which MN1 is diode-coupled at node 109 and MP2 is not diode-coupled. The loop amplifier 110 is replaced by a loop amplifier 310, which includes PMOS transistor MP4, NMOS transistor MN5, and capacitor C1. MP4 is diode-coupled having its gate and drain coupled together at node 107 and its source coupled to VDD. MN5 has its source coupled to VSS, its drain coupled to the drain of MP4, and its gate coupled to the common drains of MP2 and MN2. The capacitor C1 is coupled between the gate of MN5 and VSS. In this case, MN5 is an amplifying element, and MP4 is a load of the loop amplifier 310. C1 is provided to stabilize the loop if the loop is not already stable. In some configurations, if the loop is stable without C1, then C1 is not needed. Also, alternative methods may be used to stabilize the loop rather than the capacitor C1.

In operation of the current reference generator 301, the gate of MN5 effectively functions as the input of the loop amplifier 310 at node 104, and the gate of MP4 operates as its output at node 107. In one embodiment, MP4 is configured in substantially the same manner as MP1 and MP2, such as being another matched PMOS transistor. Also, MN5 is configured in substantially the same manner as MN2, such as having the same or similar size. During operation, the gate voltage of MN5 at node 104 is about the same as the voltage of the gates and drains of MN1 and MN2 (nodes 102 and 109), so that MN5 is biased on thus drawing another current I4 through both MP4 and MN5. Since MP4 is diode-coupled in a current mirror configuration, the current I4 flowing through a current branch created by the series drains-sources of MP4 and MN5 is related to the currents I1 and I2. If MP4 is about the same size and MP1 and MP2, then I4 is also about the same current level as I1 and I2.

If the gate voltage of MN5 attempts to increase, it increases the $V_{GS}$ of MN5 turning it on more thus attempting to increase I4. An increase of I4 tends to turn MP4 on more, thus decreasing its gate voltage and the gate voltages of MP1 and MP2 at node 107. A decrease of the voltage of node 107 tends to turn MP1 and MP2 more on resulting in a corresponding increase of I1 and I2, which tends to turn MN2 on more. If MN2 turns on more, it pulls the gate voltage of MN5 lower to counteract any tendency of increasing the gate voltage of MN5. In this manner, the loop amplifier 310 has negative feedback to drive the gates of MP1 and MP2 to keep I1 and I2 relatively constant.

The loop gain of the loop amplifier 310 has positive and negative counterparts. The negative loop gain $G(310)_{NEG}$ can be expressed according to the following equation (1):

$$G(310)_{NEG}=-A(-GM_{MP1})(-K)(R_O)=-A(GM_{MP1})(K)(R_O) \quad (1)$$

where A is the gain of the amplifier, $GM_{MP1}$ is the transconductance gain of MP1, K is a mirror factor of the current mirror components MN1 and MN2, and $R_O$ is an impedance on the drains of MN2 and MP2. The positive loop gain $G(310)_{POS}$ has a similar form and may be expressed according to the following equation (2):

$$G(310)_{POS}=-A(-GM_{MP2})(R_O)=A(GM_{MP2})(R_O) \quad (2)$$

in which $GM_{MP2}$ is the transconductance gain of MP2. If MP1 and P2 are chosen to have about the same size and configuration, then $GM_{MP1} \approx GM_{MP2}$ (in which "≈" means approximately equal or equivalent), so that the difference between the positive and negative loop gains is the mirror factor K of MN1 and MN2. Because of the presence of MN4, the mirror factor K is greater than 1 (K>1), so that the negative gain is greater than the positive gain ($G(310)_{NEG}>G(310)_{POS}$) such that the negative gain dominates the loop to ensure proper function.

The current reference generator 301 is shown including additional reference transistors for tapping and providing one or more reference currents. A first reference transistor, PMOS transistor MP5, has its source coupled to VDD, its gate coupled to node 107 and its drain providing a reference current I5. MP5 may be sized to scale the current of I5, such as to be approximately equal to I1 and I2. A second reference transistor, NMOS transistor MN6, has its gate coupled to node 104, its source coupled to VSS and its drain providing a reference current I6. MN6 may be sized to scale the current of I6, such as to be approximately equal to I1 and I2. A third reference transistor, NMOS transistor MN7 has its gate coupled to node 108, its source coupled to VSS and its drain providing a reference current I7. MN7 may be sized to scale the current of I7, such as to be approximately equal to I1 and I2.

The current reference generator 301 operates in substantially the same manner as the current reference generator 101 and exhibits substantially the same advantages. The loop amplifier 310 operates to drive the gates of MP1-MP3 to equalize the currents I1-I3. Because of the operation of the loop amplifier 310, the current level of each of the currents I1-I3 remains substantially independent of the voltage difference between VDD and VSS down to a very low voltage level, such as about $V_T$. Also, the current reference generator 301 exhibits insensitivity to temperature and process variations.

Figure 4:
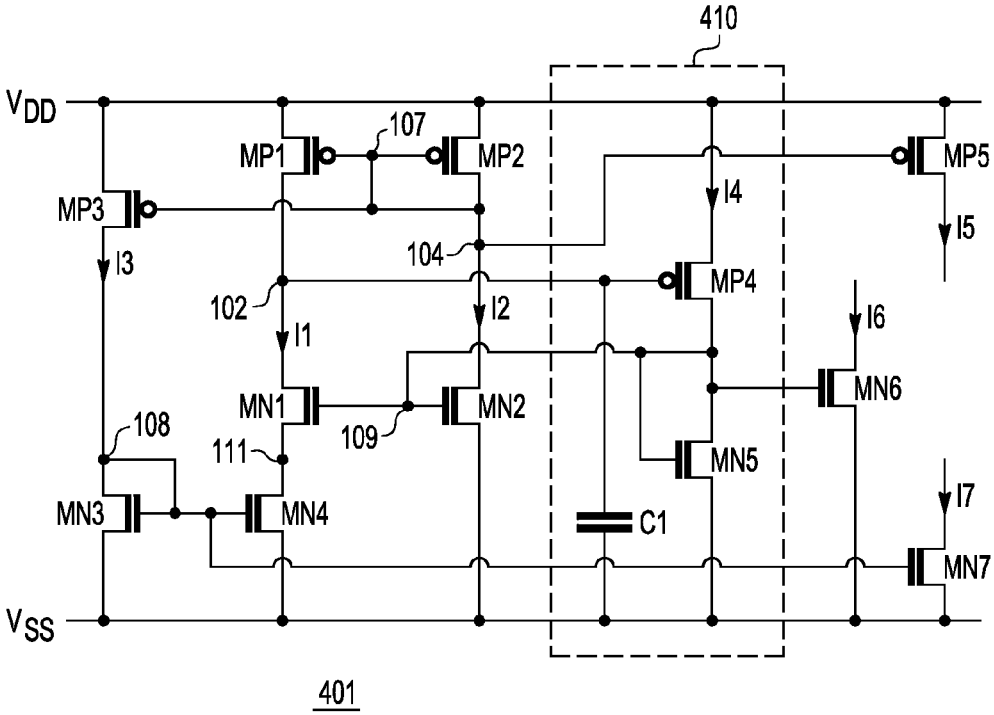
FIG. 4 is a schematic diagram of another current reference generator implemented according to another embodiment which is similar to the current reference generator of FIG. 2 including complementary devices implementing the loop amplifier.

FIG. 4 is a schematic diagram of another current reference generator 401 implemented according to another embodiment. The startup network 103 is not shown but may be included and coupled to the current reference generator 401 in substantially the same manner as previously described. The current reference generator 401 is substantially similar to the current reference generator 201 in which similar components and devices assume identical reference numbers. The transistors MP1-MP3 and MN1-MN4 are configured and coupled in substantially the same manner and also coupled in substantially the same manner in which MP2 is diode-coupled at node 107 and MN1 is not diode-coupled. The loop amplifier 210 is replaced by a loop amplifier 410, which includes PMOS transistor MP4, NMOS transistor MN5, and capacitor C1. In this case, MN5 is diode-coupled having its gate and drain coupled together at node 109 and its source coupled to VSS. MP4 has its source coupled to VDD, its drain coupled to the drain of MN5, and its gate coupled to the drains of MP1 and MN1 at node 102. The capacitor C1 is coupled between the gate of MP4 and VSS. In this case, MP4 is an amplifying element, MN5 is a load of the loop amplifier 410, and C1 is provided to stabilize the loop.

In operation of the current reference generator 401, the gate of MP4 effectively functions as the input of the loop amplifier 410 at node 102, and the gate of MN5 operates as its output at node 109. In one embodiment, MP4 is configured in substantially the same manner as MP1 and MP2, such as being another matched PMOS transistor. Also, MN5 is configured in substantially the same manner as MN2, such as having the same or similar size. During operation, the gate voltage of MP4 is about the same as the gates and drains of MP1 and MP2 (nodes 104 and 107), so that MP4 is biased on thus drawing current I4 through both MP4 and MP5. MN5 is diode-coupled in a current mirror configuration so that I4 is about the same current level as I1 and I2. If the gate voltage of MP4 attempts to increase, it decreases the $V_{GS}$ of MP4 attempting to decrease I4. A decrease of I4 tends to decrease the $V_{GS}$ of MN2, so that the current I2 through MN2 also tends to decrease. This, in turn, tends to decrease the current I1 through MN1, which tends to decrease the gate voltage of MP4, thereby closing the loop and counteracting the increase of the gate voltage of MP4. In this manner, the loop amplifier 410 has negative feedback to drive the gates of MN1 and MN2 to keep I1 and I2 relatively constant.

The loop gain of the loop amplifier 410 also has positive and negative counterparts. The negative loop gain $G(410)_{NEG}$ can be expressed according to the following equation (3):

$$G(410)_{NEG}=-A(GM_{MN2})(R_O) \quad (3)$$

where again A is the gain of the amplifier, $GM_{MN2}$ is the transconductance gain of MN2, and $R_O$ is an impedance on the drains of MN1 and MP1. The positive loop gain $G(410)_{POS}$ has a similar form and may be expressed according to the following equation (4):

$$G(410)_{POS}=-A(-GM_{MN1})(R_O)=A(GM_{MN1})(R_O) \quad (4)$$

in which $GM_{MN1}$ is the transconductance gain of MN1. MN1 and MN2 are chosen so that MN1 is larger than MN2. The presence of MN4 coupled to the source of MN1 lowers the transconductance of MN1, so that the effective transconductance gain $GM_{MN2}$ of MN2 is greater than the transconductance gain $GM_{MN1}$ of MN1. Thus, the negative gain is greater than the positive gain ($G(410)_{NEG}>G(410)_{POS}$) so that the negative gain dominates the loop to ensure proper function.

The current reference generator 401 is shown including additional reference transistors MP5, MN6 and MN7 for tapping one or more reference currents I5, I6 and I7, respectively, in a similar manner as previously described for the current reference generator 301. The respective sizes of the reference transistors are chosen to scale the reference currents as desired, where the reference currents I5-I7 are each related to the currents I1 and I2 as previously described.

The current reference generator 401 operates in substantially the same manner as the current reference generator 201 and exhibits substantially the same advantages. The loop amplifier 410 operates to drive the gates of MN1 and MN2 to equalize the currents I1-I3. Because of the operation of the loop amplifier 410, the current level of each of the currents I1-I3 remains substantially independent of the voltage difference between VDD and VSS down to a very low voltage level, such as about $V_T$. Also, the current reference generator 401 exhibits insensitivity to temperature and process variations.

Figure 5:
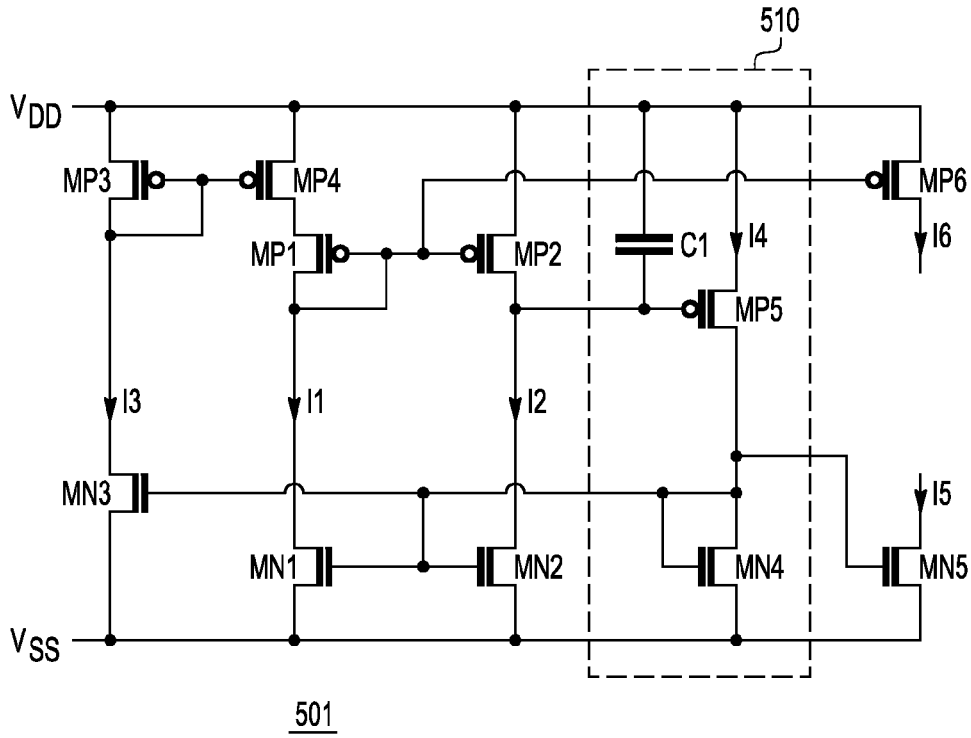
FIG. 5 is a schematic diagram of another current reference generator implemented according to another embodiment in a dual configuration of the current reference generator of FIG. 3.

FIG. 5 is a schematic diagram of another current reference generator 501 implemented according to another embodiment. The current reference generator 501 is a dual configuration of the current reference generator 301 in which VSS and VDD are swapped (i.e., VSS->VDD, VDD->VSS), each NMOS transistor is replaced by a corresponding PMOS transistor with the same index number (MN1->MP1, MN2->MP2, etc.), each PMOS transistor is replaced by a corresponding NMOS transistor with the same index number (MP1->MN1, MP2->MN2, etc.), and the schematic diagram is vertically flipped so that VDD is above and VSS is below. The loop amplifier 310 is replaced by a loop amplifier 510 including loop transistors MP5 (MN5->MP5) and MN4 (MP4->MN4) and capacitor C1. C1 is coupled between the gate of MP5 and VDD (rather than VSS, since VSS->VDD). Additional reference current transistors MN5 and MP6 are provided for providing reference currents I5 and I6, respectively. Operation is analogous to that of the current reference generator 301, in which the currents I1-I4 are substantially equal and constant. The benefits and advantages are substantially the same, in which the difference between VDD and VSS may be very low (about $V_T$) and the reference currents I1 and I2 are relatively independent of changes of VDD and VSS. Also, the current reference generator 501 exhibits insensitivity to temperature and process variations.

Figure 6:
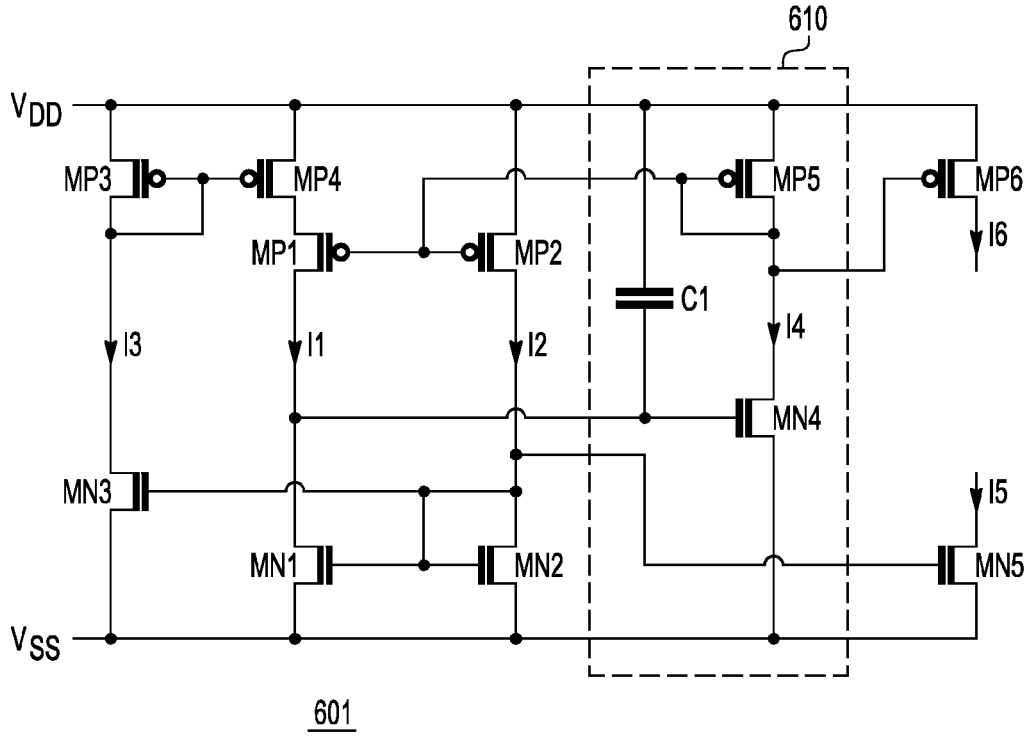
FIG. 6 is a schematic diagram of another current reference generator implemented according to another embodiment in a dual configuration of the current reference generator of FIG. 4.

FIG. 6 is a schematic diagram of another current reference generator 601 implemented according to another embodiment. The current reference generator 601 is a dual configuration of the current reference generator 401 in which VSS and VDD are swapped (i.e., VSS->VDD, VDD->VSS), each NMOS transistor is replaced by a corresponding PMOS transistor with the same index number (MN1->MP1, MN2->MP2, etc.), each PMOS transistor is replaced by a corresponding NMOS transistor with the same index number (MP1->MN1, MP2→MN2, etc.), and the schematic diagram is vertically flipped so that VDD is above and VSS is below. The loop amplifier 410 is replaced by a loop amplifier 610 including loop transistors MP5 (MN5->MP5) and MN4 (MP4->MN4) and capacitor C1. C1 is coupled between the gate of MN4 and VDD (rather than VSS, since VSS->VDD). Additional reference current transistors MN5 and MP6 are provided for providing reference currents I5 and I6, respectively. Operation is analogous to that of the current reference generator 401, in which the currents I1-I4 are substantially equal and constant. The benefits are substantially the same, in which the difference between VDD and VSS may be very low down to about $V_T$) and the reference currents I1 and I2 are relatively independent of changes of VDD and VSS. Also, the current reference generator 501 exhibits insensitivity to temperature and process variations.

While various embodiments of the present invention have been described herein, it should be understood that they have been presented by way of example, and not limitation. It will be apparent to persons skilled in the relevant arts that various changes in form and detail can be made therein without departing from the scope of the invention. Finally, those skilled in the art should appreciate that they can readily use the disclosed conception and specific embodiments as a basis for designing or modifying other structures for carrying out the same purposes of the present invention without departing from the scope of the invention as defined by the appended claims.

The invention claimed is:

1. A current reference generator, comprising:

a current network, comprising:

first and second transistors of a first conductivity type each having a first current terminal coupled to a first supply line and having a control terminal coupled to a first node, wherein said first transistor has a second current terminal coupled to a second node and wherein said second transistor has a second current terminal coupled to a third node;

a third transistor of a second conductivity type having a first current terminal coupled to said second node, having a control terminal coupled to a fourth node, and having a second current terminal coupled to a fifth node;

a fourth transistor of said second conductivity type having a first current terminal coupled to said third node, having a control terminal coupled to said fourth node, and having a second current terminal coupled to a second supply line;

a fifth transistor of said second conductivity type having a first current terminal coupled to said fifth node, having a second current terminal coupled to said second supply line, and having a control terminal; and wherein said third transistor is diode-coupled in which said second and fourth nodes are coupled together;

a bias network coupled to at least one of said first and second supply lines and having a control output coupled to said control terminal of said fifth transistor; and a loop amplifier having an input coupled to said third node and an output coupled to said first node, wherein said loop amplifier is operative to maintain relatively constant current level through said first, third and fifth transistors.

2. The current reference generator of claim 1, wherein said loop amplifier comprises:

a voltage source providing a reference voltage indicative of said fourth node; and an operational amplifier having an inverting input coupled to said third node, a non-inverting input receiving said reference voltage, and an output coupled to said first node.

3. The current reference generator of claim 1, wherein said loop amplifier comprises:

a sixth transistor of said first conductivity type having a first current terminal coupled to said first supply line, and having a second current terminal and a control terminal both coupled to said first node; and a seventh transistor of said second conductivity type having a first current terminal coupled to said first node, having a control terminal coupled to said third node, and having a second current terminal coupled to said second supply line.

4. The current reference generator of claim 3, further comprising a capacitor coupled between said third node and said second supply line.

5. The current reference generator of claim 1, further comprising a startup network coupled to initiate current through said first, third and fifth transistors.

6. The current reference generator of claim 5, wherein said startup network comprises:

a sixth transistor of said second conductivity type having a first current terminal coupled to said first node, having a second current terminal coupled to said second supply line, and having a control terminal;

a seventh transistor of said second conductivity type having a first current terminal coupled to said control terminal of said sixth transistor, a control terminal coupled to said fourth node, and having a second current terminal coupled to said second supply line; and a capacitor coupled between said first supply line and said control terminal of said sixth transistor.

7. The current reference generator of claim 1, wherein said bias network comprises:

a sixth transistor of said first conductivity type having a control terminal coupled to said first node, having a first current terminal coupled to said first supply line and having a said second current terminal to said control terminal of said fifth transistor; and a seventh transistor of said second conductivity type having a control terminal and a first current terminal both coupled to said control terminal of said fifth transistor, and having a second current terminal coupled to said second supply line.

8. The current reference generator of claim 1, wherein said third, fourth and fifth transistors are sized to develop a voltage on said fifth node having a voltage level between voltages of said first and second supply lines.

9. The current reference generator of claim 1, wherein said first conductivity type comprise one of P-type and N-type and wherein said second conductivity type comprises the other one of P-type and N-type.

10. The current reference generator of claim 1, wherein each of said transistors of said first conductivity type comprises one of a PMOS transistor and an NMOS transistor and wherein each of said transistors of said second conductivity type comprises the other one of a PMOS transistor and an NMOS transistor.

11. The current reference generator of claim 1, further comprising at least one output reference device coupled to said current network for mirroring current through said first and second current terminals of said fifth transistor.

12. A current reference generator, comprising:

a current network, comprising:

first and second transistors of a first conductivity type each having a first current terminal coupled to a first supply line and having a control terminal coupled to a first node, wherein said first transistor has a second current terminal coupled to a second node and wherein said second transistor has a second current terminal coupled to a third node;

a third transistor of a second conductivity type having a first current terminal coupled to said second node, having a control terminal coupled to a fourth node, and having a second current terminal coupled to a fifth node;

a fourth transistor of said second conductivity type having a first current terminal coupled to said third node, having a control terminal coupled to said fourth node, and having a second current terminal coupled to a second supply line;

a fifth transistor of said second conductivity type having a first current terminal coupled to said fifth node, having a second current terminal coupled to said second supply line, and having a control terminal; and wherein said second transistor is diode-coupled in which said first and third nodes are coupled together;

a bias network coupled to at least one of said first and second supply lines and having a control output coupled to said control terminal of said fifth transistor; and a loop amplifier having an input coupled to said second node and an output coupled to said fourth node, wherein said loop amplifier is operative to maintain relatively constant current level through said first, third and fifth transistors.

13. The current reference generator of claim 12, wherein said loop amplifier comprises:

a voltage source providing a reference voltage indicative of said first node; and an operational amplifier having an inverting input coupled to said second node, a non-inverting input receiving said reference voltage, and an output coupled to said fourth node.

14. The current reference generator of claim 12, wherein said loop amplifier comprises:

a sixth transistor of said first conductivity type having a first current terminal coupled to said first supply line, having a second current terminal coupled to said fourth node, and having a control terminal coupled to said second node; and a seventh transistor of said second conductivity type having a first current terminal and a control terminal both coupled to said fourth node, and having a second current terminal coupled to said second supply line.

15. The current reference generator of claim 14, further comprising a capacitor coupled between said second node and said second supply line.

16. The current reference generator of claim 12, further comprising a startup network coupled to initiate current through said first, third and fifth transistors.

17. The current reference generator of claim 16, wherein said startup network comprises:

a sixth transistor of said second conductivity type having a first current terminal coupled to said first node, having a second current terminal coupled to said second supply line, and having a control terminal;

a seventh transistor of said second conductivity type having a first current terminal coupled to said control terminal of said sixth transistor, a control terminal coupled to said fourth node, and having a second current terminal coupled to said second supply line; and a capacitor coupled between said first supply line and said control terminal of said sixth transistor.

18. The current reference generator of claim 12, wherein said bias network comprises:

a sixth transistor of said first conductivity type having a control terminal coupled to said first node, having a first current terminal coupled to said first supply line and having a said second current terminal to said control terminal of said fifth transistor; and a seventh transistor of said second conductivity type having a control terminal and a first current terminal both coupled to said control terminal of said fifth transistor, and having a second current terminal coupled to said second supply line.

19. The current reference generator of claim 12, wherein said third, fourth and fifth transistors are sized to develop a voltage on said fifth node having a voltage level between voltages of said first and second supply lines.

20. The current reference generator of claim 12, wherein said first conductivity type comprise one of P-type and N-type and wherein said second conductivity type comprises the other one of P-type and N-type.

21. The current reference generator of claim 12, wherein each of said transistors of said first conductivity type comprises one of a PMOS transistor and an NMOS transistor and wherein each of said transistors of said second conductivity type comprises the other one of a PMOS transistor and an NMOS transistor.

22. The current reference generator of claim 12, further comprising at least one output reference device coupled to said current network for mirroring current through said first and second current terminals of said fifth transistor.

* * * * *